US006260812B1

(12) United States Patent
Auke

(10) Patent No.: US 6,260,812 B1
(45) Date of Patent: Jul. 17, 2001

(54) ARRANGEMENT IN A STAND, ESPECIALLY A MUSIC STAND

(76) Inventor: Trond Auke, Vagebyveien 11, N-1312 Slependen (NO)

( * ) Notice: Subject to any disclaimer, the term of this patent is extended or adjusted under 35 U.S.C. 154(b) by 0 days.

(21) Appl. No.: 09/308,216

(22) PCT Filed: Sep. 9, 1997

(86) PCT No.: PCT/NO97/00240

§ 371 Date: May 14, 1999

§ 102(e) Date: May 14, 1999

(87) PCT Pub. No.: WO98/22001

PCT Pub. Date: May 28, 1998

(30) Foreign Application Priority Data

Nov. 15, 1996 (NO) ..... 19964855

(51) Int. Cl.[7] ..... A47B 97/04

(52) U.S. Cl. ..... 248/460; 248/447; 248/462; 248/463

(58) Field of Search ..... 248/460, 441.1, 248/447, 462, 463, 464, 465

(56) References Cited

U.S. PATENT DOCUMENTS

| | | | | |
|---|---|---|---|---|
| 696,993 | | 4/1902 | Mills | 248/462 |
| 765,187 | * | 7/1904 | Meyer et al. | 248/461 |
| 935,592 | | 9/1909 | Dougherty | 248/462 |
| 987,547 | * | 3/1911 | Caputi | 248/461 |
| 1,667,171 | | 4/1928 | Sholin | 248/452 |
| 1,905,109 | | 4/1933 | Krauth | 248/462 |
| 2,046,134 | * | 6/1936 | Ryang | 248/461 |
| 4,355,779 | * | 10/1982 | Heled | 248/460 |
| 4,372,518 | * | 2/1983 | Biasini | 248/441.1 |
| 4,488,469 | * | 12/1984 | Demello et al. | 84/385 A |
| 4,606,525 | | 8/1986 | Lombardi | 248/460 |
| 5,016,852 | * | 5/1991 | Herendeen | 248/461 |

* cited by examiner

*Primary Examiner*—Anita M. King
(74) *Attorney, Agent, or Firm*—Volpe and Koenig, P.C.

(57) ABSTRACT

The present invention relates to a stand (1) which can be collapsed for transportation and storage and unfolded when in use, comprising an upper stand head (2) arranged to support sheet-like objects, in particular sheets of music, and a rod-shaped central part (4) and preferably a lower leg arrangement (5), or similar, and with the objective of providing an improved stand both as regards its haandling, use and transportation, it is proposed according to the invention that the upper stand head (2) comprises extendable stays (6, 7).

19 Claims, 3 Drawing Sheets

Fig.1.
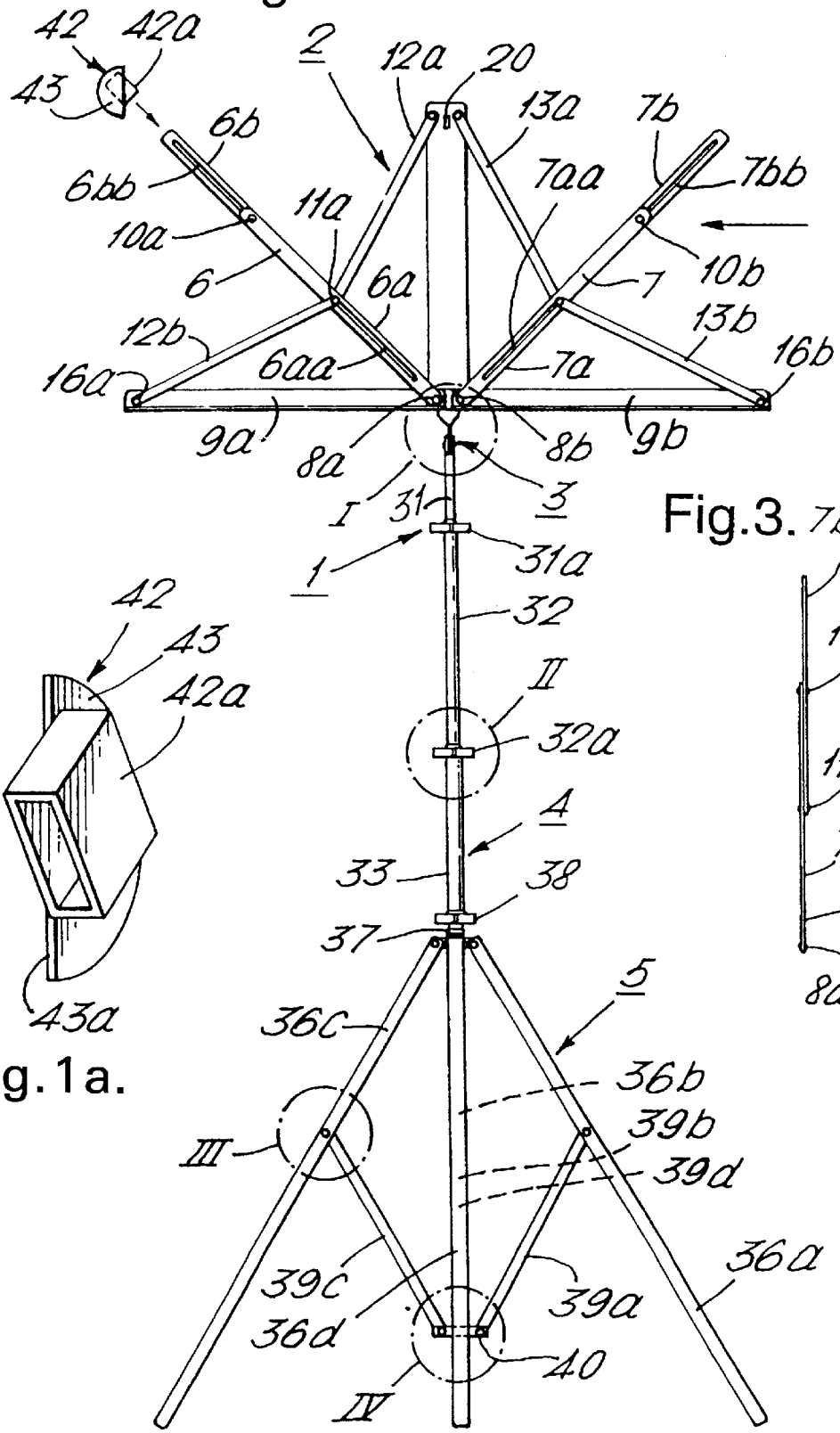
Fig.3.
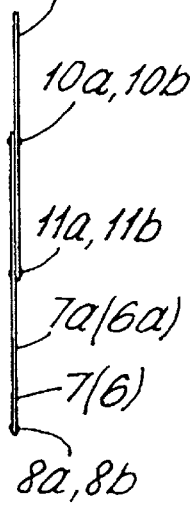
Fig.1a.

Fig.4.
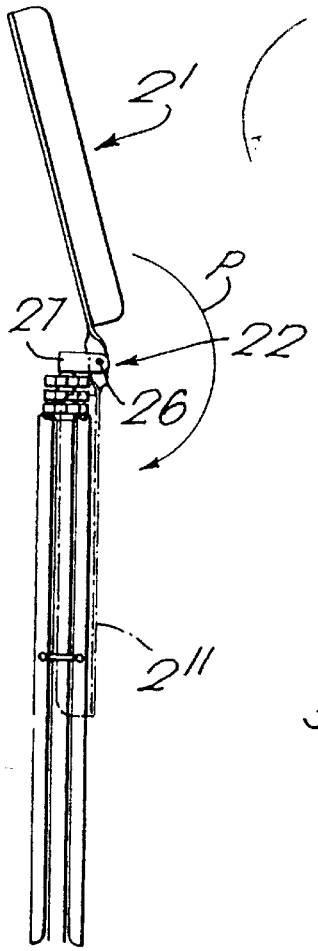
Fig.5.
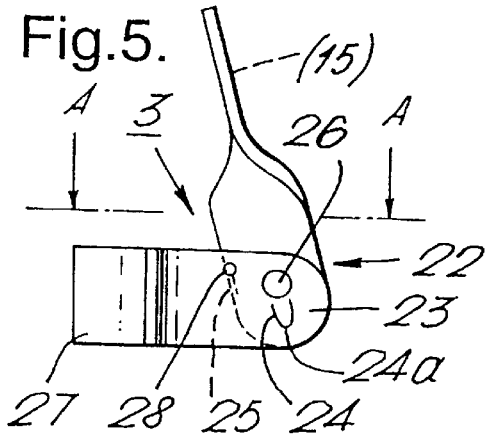
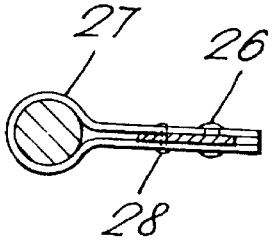
Fig.5a.
Fig.6.
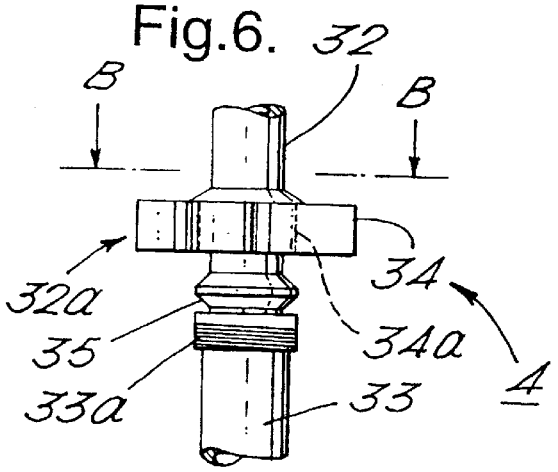
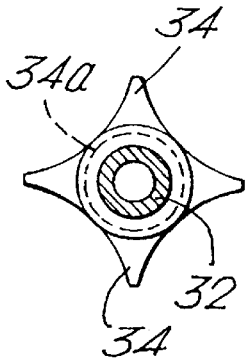
Fig.6a.
Fig.7.
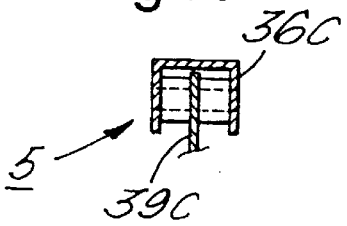
Fig.8.
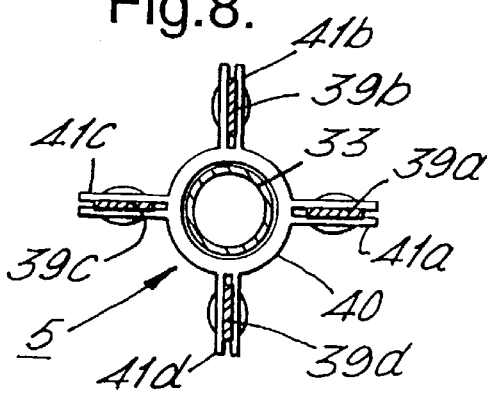

ARRANGEMENT IN A STAND, ESPECIALLY A MUSIC STAND

THE SCOPE OF THE INVENTION

The present invention relates to an arrangement in a stand, especially in a music stand.

More particularly, the present invention relates to a stand which can be collapsed transportation and storage and can be unfolded in use, comprising an upper stand head which is arranged to support sheet-like objects, in particular music sheets, and a rod-shaped central portion and preferably a lower leg arrangement or such like.

PRIOR ART

Previously known is a music stand of the type stated initially in which the upper stand head comprises a plurality of interconnected and rotatable stays which will with a special technique permit themselves to be folded up, respectively collapsed. This known music stand is, however, encumbered with the disadvantage that it requires a certain skill for it to be unfolded, while at the same time it fails, in its position for use, to comprise members for holding down the sheets of music, something which makes such stands ill suited for outdoor use.

Another disadvantage with which the known stands are encumbered is that in their collapsed state they take up unreasonably large space, and when several of these stands are transported in a container, the collapsed stands will tend to become entangled which may cause the stands to be subjected to damage, both during transportation and when they are later unpacked.

BACKGROUND TO THE INVENTION

The basis for the present invention is the task to provide a description of a stand, in particular a music stand which compared with prior art, is considerably easier to handle.

Another objective of the invention is to provide a stand in which there is no possibility of parts being trapped or stuck when being folded out or being collapsed.

Another objective of the invention is to provide a stand which takes up less space in its collapsed state.

Another objective of the invention is to provide a stand which protects the individual parts of the stand when the stand is folded up, in order thereby to avoid entangling during transportation of several stands in one and the same container.

A further objective of the invention is to provide a stand which will in its position when in use provide improved support for the sheets of music, which provides improved fastening of the stand's head when in use, which provides a more stable position when in use, both of the stand's head and supporting legs, and which also provides a suitable interlocking effect between the parts of the stand in its collapsed state.

These intentions are achieved with a stand of the type mentioned initially, which is characterised in that the upper stand head comprises extendable stays.

In particular the aim of invention is that the stand comprises two main stays, each in turn comprising two joints which can be displaced relative to each other.

More particularly, the aim of the invention is that each of the two main stays comprises one initial stay joint of a certain length and executed with a longitudinal groove of a certain extent, as well as a second stay joint which is executed with a second longitudinal groove of substantially the same extent as the said initial groove, and being arranged to be displaced substantially in the same longitudinal direction as the initial stay joint.

Additional advantages and features of the present invention will become evident from the description below, taken in conjunction with the attached drawings, and from the the attached patent claims.

BRIEF DESCRIPTION OF THE FIGURES OF THE DRAWINGS

FIG. 1 is an outline sketch of an embodiment for a preferred embodiment of a stand according to the invention, shown in its unfolded position, ready for use.

FIG. 1*a* is a perspective view of a stay tip of the stand as shown in FIG. 1.

FIG. 3 shows in a sideways sketch a section of some of the main components which are part of the stand as shown in FIG. 1.

FIG. 4 shows a sideways sketch of a stand according to the invention, here with its upper main part partly folded, and shown in an unbroken line in an upper position, while shown in a broken line is the folded stand head tipped down and folded round the rod-shaped central part.

FIG. 5 shows a section of a rotating joint between the upper part of the stand and its rod-shaped central part.

FIG. 5*a* is a cross-section view taken along line A—A of FIG. 5.

FIG. 6 shows on a larger scale details of the telescopic function which has been placed in the rod-shaped central part of the stand as shown in FIG. 1.

FIG. 6*a* is a cross-section view taken along line B—B of FIG. 6.

FIG. 7 shows details which are part of an improved leg arrangement of the stand as shown in FIG. 1.

FIG. 8 shows on a larger scale additional details of the leg arrangement which is part of the embodiment as shown in FIG. 1.

DETAILED DESCRIPTION OF THE EMBODIMENT

Figures 2, 2A:
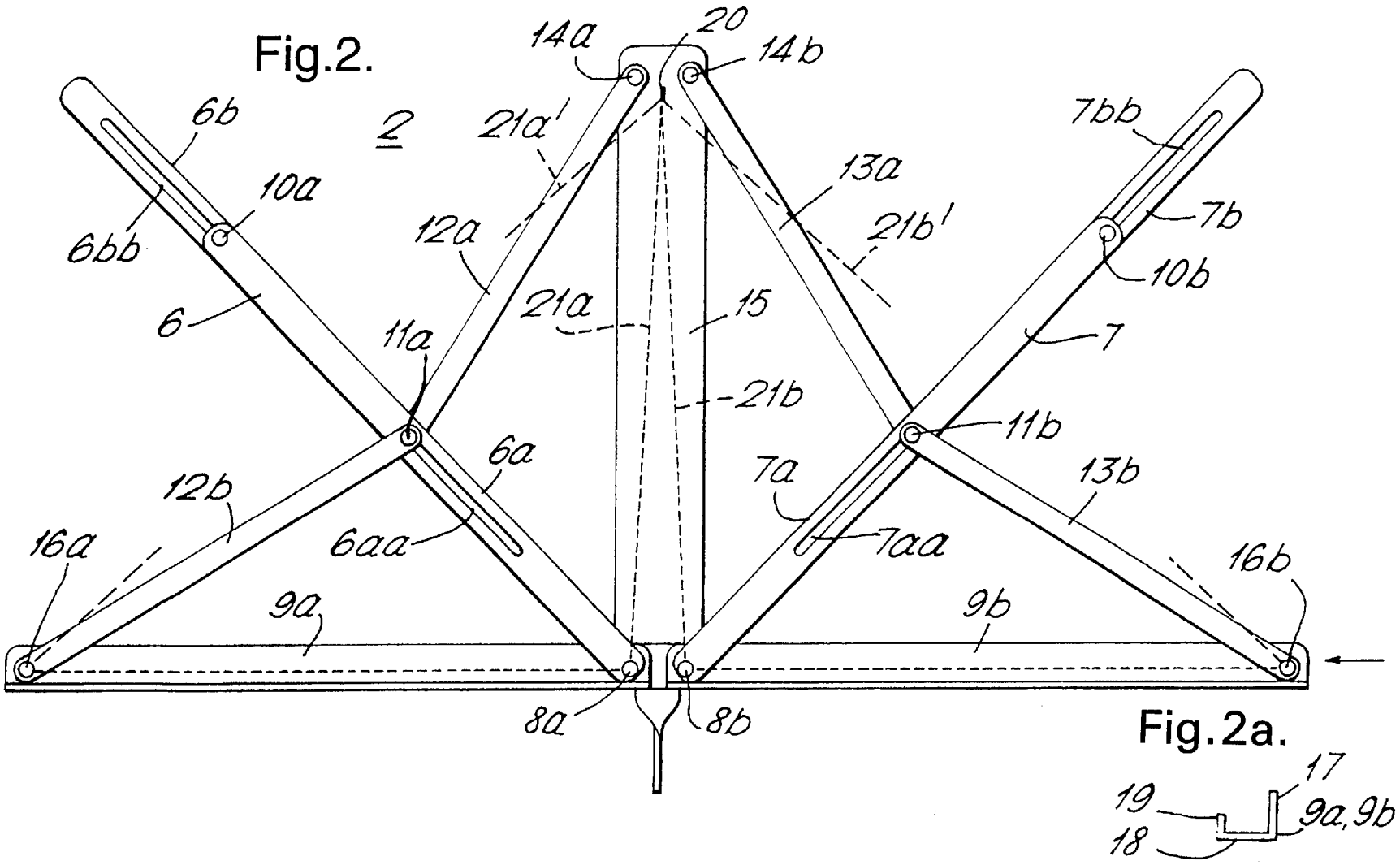
FIG. 2 shows on a larger scale an outline sketch of the upper stand head, also here shown in its unfolded position, ready for use.
FIG. 2*a* is an end view of a main frame supporting component of the stand illustrated in FIG. 2.

Shown in FIG. 1 is an embodiment of a stand according to the present invention, especially a music stand, the said stand being indicated by the reference numeral 1 and being of the type which can be folded up for transportation and storage and unfolded, as shown in FIG. 1, when in use.

The stand 1 as shown in FIG. 1 comprises an upper stand head 2 which in its unfolded position is arranged to support sheet-like objects, especially music sheets, the said stand head 2 being provided with a connection 3, especially of the kind as shown in detail in FIG. 5, to be connected to a rod-shaped central part, generally indicated with the reference numeral 4, which may be of the telescope type, comprising details as shown in FIG. 6, and in turn carrying or communicating with a lower leg arrangement, indicated here in general by the reference number 5, and comprising details as especially shown in the FIGS. 7 and 8.

What is particular in the present invention is that the upper stand head 2 comprises extendable stays, and then more specifically two main stays 6 and 7, respectively, each of these main stays 6 and 7 comprising two joints, 6*a*, 6*b* and 7*a*, 7*b*, respectively, which can be mutually displaced relative to each other.

As will be evident from FIG. 1 and in particular from FIG. 3, each of the two main stays 6 and 7 comprises a first stay joint, 6*a* and 7*a*, respectively, of a certain length and executed with a longitudinal groove, 6*aa* and 7*aa*, respectively, of a certain extent, and a second stay joint, 6*b* and 7*b*, respectively, executed each with its longitudinal groove, 6*bb* and 7*bb*, respectively, of substantially the same extent as the said initial groove, and arranged so as to be displaceable substantially in the same longitudinal direction as the pertaining initial stay joint.

It is moreover evident from FIG. 1 that the initial stay joint, 6*a* and 7*a*, respectively, executed with a certain length, is rotatably attached each at its rotation point, 8*a* and 8*b*, respectively, at the central part of the two main frame components, 9*a* and 9*b*, respectively, which will, in the unfolded position as shown in FIG. 1, serve as a lower support for the sheet of music, which is evident in further detail from FIG. 2. Each of the other stay joints, 6*b* and 7*b*, respectively, is fastened to its initial stay joint, 6*a* and 7*a*, respectively, by means of a separate upper through-going guiding and holding device, 10*a* and 10*b*, respectively, the said other stay joints, 6*b* and 7*b*, respectively, in addition being fastened to a lower through-going guiding and holding device, 11*a* and 11*b*, respectively, to which are also rotatably fastened an upper and a lower cross stay, 12*a* and 12*b*, respectively, for one main stay 6, and 13*a* and 13*b*, respectively, for the other main stay 7.

Each of the upper cross stays, 12*a* and 13*a*, respectively, is at its respective extreme upper end fastened rotatably at rotation points 14*a* and 14*b*, respectively, to a central column 15, protruding upwards from the central part of the two main frame components 9*a* and 9*b*, while at the same time the respective lower cross stay 12*b* and 13*b*, respectively, is at its extreme lower end fastened rotatably in rotation points 16*a* and 16*b*, respectively, at a respectively outer area of the relevant main frame component 9*a* and 9*b*, respectively.

It should be understood that the previously mentioned rotation points 8*a* and 8*b* at the central portion of the main frame components 9*a* and 9*b*, also serve as pivot points for the said main frame components 9*a* and 9*b*, entailing that upon lifting of the frame components 9*a* and 9*b* towards each other for collapsing the upper main part or stand head 2, the said cross stays 12*a*, 12*b* and 13*a* and 13*b* will have their central rotation points 11*a*, 11*b* displaced downwards in corresponding grooves 6*aa*, respectively 7*aa*, while at the same time the extendable stays 6, respectively 7, are pulled together in order to form, in their collapsed position, a compact stand head 2' the way this is shown in FIG. 4. As is in particular evident from FIG. 2, each of the main frame components 9*a*, 9*b*, comprises a substantially longitudinal frame, the way this is shown on the right in FIG. 2, i.e. comprising a rear supporting area 17, a bottom area 18, and a frontal supporting area 19 which in combination form a good support for the lower edge of a paper or a sheet of music to be supported by the stand head 2 of the present stand 1.

It should be understood that the said rear supporting edge 17 forms a support for the said rotation points 8*a*, 8*b* of the displaceable stays, and for the two main frame components 9*a*, 9*b*, as well as for the rotation points 16*a*, 16*b* of the said cross stays 12*b* and 13*b*.

From FIG. 2 it is also evident that, at the upper part of the central column 15 there is arranged a lug or a hook 20, extending from which there is a left-hand rubber band 21*a* via the lower rotation point 8*a* and to the outer rotation point 16*a*, the rubber band 21*a* being arranged so that it can be unhooked at the central rotation point 8*a* in order to be let out to the position shown by reference numeral 21*a'*, which is also the case with a right-hand rubber band 21*b* which can be slipped off the second central rotation point 8*b* to take up the position shown by reference numeral 21*b'*, and together with the other rubber band 21*a'* constitute a further holding member for the sheets or papers being supported by the stand head 2 of the present stand 1.

Shown in FIG. 5 is an appropriate rotating/holding device 22 for a connection between the upper stand head 2 and the rod-shaped central part 4, with a flat, rounded area 23 extending from the lower area for the central column 15 and being executed with an initial groove 24 and a second groove 25, the initial groove 24 permitting displacement relative to a bolt 26 secured in a cross piece 27 at the top of the rod-shaped central part 4, and the said second groove 25 being displaceable relative to a small bolt 28, also shaped on the said cross piece 27.

The connection 22 entails that the stand head 2 is in its position for use capable of taking a suitably inclined position relative to the rod-shaped central part 4, in that the stand head 2 is lifted up and swung into place for its inclined position where the second groove 25 is hooked on to the smaller bolt 28, thereby taking up a stationary position without any further need for being screwed down, which is the case with previously known stand head.

When the stand head 2 is collapsed it is first collapsed as previously mentioned, in that the main frame components 9*a*, 9*b* are pushed upwards, while at the same time the stay sections are pulled together, and while at the same time the main frame components 9*a*, 9*b* with their shape as an angular frame encompass the collapsed stay sections and the central column 15, as shown by reference numeral 2' in FIG. 4. Thereafter, the folded head 2, 2' respectively, is lifted by pulling upwards which entails that the lower part 23 of the stand head 2 is pulled upwards along the bolt 26, while at the same time the smaller bolt 28 is pulled out of its pertaining groove 25, whereupon the folded head 2' can rotate on the bolt 26, as shown by the arrow P in FIG. 4, to the position shown in a broken line and indicated by reference numeral 2". In that position the weight of the head will cause the whole head to be locked into the narrower part 24*a* of the said groove 24 which will encompass the said bolt 26. This affords a compact and stable folded position requiring a minimum of space during transportation with minimal risk of entangling with other stands.

From FIG. 1 it is evident that the rod-shaped central part 4 is constructed according to the telescope principle, comprising a first upper tube 31 which is via a locking mechanism adjustably displaceable in a second tube 32 which is turn, by means of a locking mechanism 32*a*, displaceable in a third tube 33, which in turn carries the leg arrangement 5 previously mentioned. Shown in FIG. 6 are details of the locking device 32*a* which is arranged between the second tube 32 and the third tube 33, and shown on the right-hand side of this figure is a base sketch of the wheel 34 which may be used, being executed with internal thread 34*a* which may engage with the thread 33*a* of the tube 33 while at the same time a washer 35 is being compressed and forced outwards to hold the tubes 32 and 33 in the desired extended or contracted position.

Shown in FIG. 1 is furthermore that the leg arrangement 5 comprises four individually inclined legs 36*a*–36*d* which protrude at an angle from an upper fastening point 37 provided with a suitable handle 38 for displacement of the fastening point 37 along the lower tube 33 in order thereby to be able to push out the four inclined legs 36*a*–36*d* in that these are provided each with its inclined strut 39*a*–39*d*, respectively, protruding from the central area of the each respective leg, and with an opposite inclined position, in order at their other ends to be fastened in a lower ring 40 arranged to be held on the lower tube 33. It should be understood that the upper handle 38 may be loosened to allow either a downwards movement at which the legs unfold to their position when in use, respectively in an upwards movement where the legs are collapsed to their mounted transportation position.

Additional features of the ring 40 are evident from FIG. 8 where it encompasses the lower tube section 33 and is executed with four fastening points 41*a*–41*d*, respectively, for fastening of the inclined leg struts mentioned, 39*a*–39*d*, respectively.

Shown in FIG. 7 is a detail of the fastening between the respective inclined leg 36*c* which, incidentally is substantially executed with a angled U-profile, and the pertaining upper part of the respective inclined leg strut, here the leg strut 39*c*.

The advantages of the stand according to the present invention and the way this is represented in the embodiment shown in the the attached drawings may be summarised as follows:

The extendable stays entail that the actual stand head may be unfolded and collapsed in a simple and rational manner.

Collapsing it entails that the collapsible stays can all be accommodated in suitable parts of the main frame, with the design of the frame also providing improved support for sheets of music in its position in use.

The fastening point between the stand head and the rod-shaped central part entails firstly a stable position when in use without the use of nuts which entails a minimum of wear and tear and avoidance of rusty parts. Secondly this type of fastening entails that mounting and dismantling can be done in one simple lifting and twisting movement both on mounting and similarly on dismantling, while at the same time the fastening device provides a good lock collapsed position of the stand head in its collapsed state.

In addition the stand according to the invention offers improved properties for outdoor use, the parts of the main frame providing an additional supporting edge for the sheets of music, the stand head comprising a simple rubber band attachment for additional holding-down of the sheets of music, while at the same time the leg arrangement is executed with four legs, giving extra stability in use.

Because the stand is executed with a minimum of stays, the stand will be of comparatively low weight, yet be stable because of the four legs which unfold for the use position.

Neither in the unfolding nor the collapsing is there any danger of parts being wedged, and in a collapsed position, both as regards the stand head and the leg arrangement, will the stand be of a volume smaller than previously known stands, while at the same time the extendable stays are protected by other and more robust parts of the stand head.

Due to its low weight and better protected parts in a collapsed position, the stand is well suited for transport of several stands in the same container without the danger of entangling and damage to the parts.

The stand incidentally also comprises parts which are practically speaking maintenance-free and not very exposed to wear and tear etc.

Finally, shown in FIG. 1 is a clamp 42 (also shown on a larger scale) which at one side has a sleeve area 42*a* which can be slipped on to e.g. the stay 6 at the upper free end of the latter, and on its other side has a springy crescent-shaped area 43 being partly attached at its rear edge to the sleeve area 42*a* and constituting partly a flexible holding surface for the the edge of a sheet of music, i.e. between the inner surface 43*a* of the area 43, and an adjoining surface of the sleeve area 42*a*.

What is claimed is:

1. A stand (1) which can be collapsed during transportation and storage and be unfolded for use, comprising an upper stand head (2) arranged to support sheet-like objects, and a rod-shaped central part (4) and preferably a lower leg arrangement (5), characterised in that the upper stand head (2) comprises main stays (6, 7) each of which is freely extendable and allows lengthening or shortening at a free end thereof, each of said main stays (6, 7) includes first and second stays, each of said first stays (6*a*; 7*a*) is at one end fastened rotatably (8*a*; 8*b*) to a lower central area of the stand head (2), each of said second stays (6*b*; 7*b*) is fastened displaceably relative to one of said first stays (6*a*; 7*a*) by an upper guiding and holding device (10*a*; 10*b*) which passes through the respective first stay and displaceably engages the respective second stay at a groove in the second stay, each of said second stays (6*b*; 7*b*) in addition is fastened to a lower guiding and holding device (11*a*; 11*b*) which passes through the respective second stay (6*b*; 7*b*) and displaceably engages the respective first stay at a groove in the first stay, and the lower guiding and holding device is also rotatably fastened to an upper cross stay (12*a*; 13*a*) and a lower cross stay (12*b*; 13*b*).

2. The stand as stated in claim 1 wherein said groove of each respective first stay (6*a*; 7*a*) is of a certain length and said groove of each said second stay is of substantially the same length.

3. The stand as stated in claim 2, characterised in that the extendable main stays (6, 7) are fastened rotatably at respective rotation points (8*a*; 8*b*) at an inner end of one of two main frame components (9*a*; 9*b*) in order thereby to have a common rotation point with respect to the lower central area of the stand head, said main frame components (9*a*; 9*b*) being in the shape of an open duct, comprising a bottom area (18) for the support of sheet-like objects, a front support edge (19) for retention of the sheet-like objects, as well as a rear load-carrying support edge (17).

4. The stand as stated in claim 1, characterised in that the upper stand head comprises two main frame components (9*a*, 9*b*) which in an unfolded position serve as a lower support for the sheet-like objects, wherein each main frame component is at an inner area rotatably fastened at the lower central area of the stand head (2) preferably at rotating points (8*a*, 8*b*) common with the extendable stays (6, 7) and each main frame component comprising at an outer end a rotation point (16*a*; 16*b*) for a lower end of the lower respective cross stay (12*b*; 13*b*) and the respective upper cross stay (12*a*; 13*a*) being affixed to a central column (15).

5. The stand as stated in claim 4, characterised in that the extendable main stays (6, 7) arc fastened rotatably at respective rotation points (8*a*; 8*b*) at an inner end of one of the two main frame components (9*a*; 9*b*) in order thereby to have a common rotation point with respect to the lower central area of the stand head, said main frame components (9*a*; 9*b*) being in the shape of an open duct, comprising a bottom area (18) for support of the sheet-like objects, a front support edge (19) for retention of the sheet-like objects, as well as a rear load-carrying support edge (17).

6. The stand as stated in claim 1, characterised in that the extendable stays (6, 7) are arranged to be accommodated in duct-shaped main frame components (9*a*, 9*b*) when the stand head (2) is collapsed.

7. The stand as stated in claim 1, characterised in that the upper stand head (2) with extendable main stays (6, 7) is fastened to the rod-shaped central part (4) by connecting means (22) for permitting a stable inclined mounting position of the stand head (2) when in use, while also permitting simple, lifting and twisting movement when collapsing the stand head into the stand head's transportation position.

8. The stand as stated in claim 1, characterised in that the rod-shaped central part (4) includes a plurality of telescope tubes (31, 32, 33) and suitable locking devices (31*a*, 32*a*) each comprising threaded wheels (34), an elastic washer (35) and corresponding threads (33*a*).

9. The stand as stated in claim 1, characterised in that the leg arrangement (5) comprises four individual legs (36*a*–36*d*) having upper areas fastened in a displaceable (37) and lockable (38) ring and having rotatably fastened central areas connected by inclined struts (39*a*–39*d*) fastened in a lower ring (40).

10. The stand as stated in claim 1, characterised in that the extendable main stays (6, 7) are fastened rotatably at respective rotation points (8*a*; 8*b*) at an inner end of one of two main frame components (9*a*; 9*b*) in order thereby to have a common rotation point with respect to the lower central area of the stand head, said main frame components (9*a*; 9*b*) being in the shape of an open duct, comprising a bottom area (18) for support of the sheet-like objects, a front support edge (19) for retention of the sheet-like objects, as well as a rear load-carrying support edge (17).

11. The stand as stated in claim 1, wherein the stand head has a central column and opposing main frame sheet supporting components characterised in that each respective rotation point (8*a*, 8*b*) also forms a hooking point for a rubber band (21*a*; 21*b*); wherein the rubber band extends in a hooked position along the respective main frame component (9*a*; 9*b*) around the hooking point and to an upper area (20) of the central column (15), where in one position (21*a*'; 21*b*') the rubber band extends from an outer end of each main frame component to the upper area of the central column, to form additional support for the sheet-like objects which are on the stand head (2) when the latter is in an unfolded position for use.

12. A stand which can be collapsed during transportation and storage and be unfolded for use, comprising an upper stand head (2) arranged to support sheet-like objects, a rod-shaped central part (4) and preferably a lower leg arrangement (5), characterised in that the upper stand head (2) comprises main stays (6, 7) each of which is freely extendable and allows lengthening or shortening at a free end thereof, each of the extendable stays (6, 7) is fastened rotatably at a rotation point (8*a*; 8*b*) at an inner end of one of two main frame components (9*a*; 9*b*) in order thereby to have a common rotation point with respect to a lower central area of the stand head, the main frame components (9*a*; 9*b*) being in the shape of an open duct, comprising a bottom area (18) for support of the sheet-like objects, a front support edge (19) for retention of the sheet-like (objects, as well as a rear load-carrying support edge (17) which supports said rotation points (8*a*; 8*b*).

13. The stand as stated in claim 12, characterised in that the main stays (6, 7), each comprise a respective first stay (6*a*; 7*a*) connected by a joint to a respective second stay (6*b*; 7*b*) which can be displaced longitudinally relative to each other.

14. The stand as stated in claim 12 characterised in that each of the two extendable main stays (6, 7) comprises a first stay (6*a*; 7*a*) wherein each first stay (6*a*; 7*a*) is provided with a first longitudinal groove (6*aa*; 7*aa*) of a certain length, and is connected by a joint to a respective second stay (6*b*; 7*b*) wherein each second stay is provided with a second longitudinal groove (6*bb*; 7*bb*) of substantially the same length as the said first groove (6*aa*; 7*aa*) such that said grooves define the relative travel between said respective first and second stays.

15. The stand as stated in claim 12 characterised in that each main stay (6, 7) includes first and second stays and that each first stay (6*a*; 7*a*) is at one end fastened rotatably (8*a*; 8*b*) to a lower central area of the stand head (2), and that each second stay (6*b*; 7*b*) is fastened displaceably relative to the respective first stay (6*a*; 7*a*) by an upper guiding and holding device (10*a*; 10*b*) which passes through the respective first stay and displaceably engages the second stay at a groove in said second stay, and that each second stay (6*b*; 7*b*) in addition is fastened to a lower guiding and holding device (11*a*; 11*b*) which passes through the second stay (6*b*; 7*b*) and displaceably engages the respective first stay at a groove in said first stay, and the lower guiding and holding device is also rotatably fastened to an upper cross stay (12*a*; 13*a*) and a lower cross stay (12*b*; 13*b*).

16. The stand as stated in claim 12 wherein the upper stand head has a central column and the two main frame components, characterised in that each rotation point (8*a*, 8*b*) also forms a hooking point for a rubber band (21*a*; 21*b*); wherein the rubber band extends in a hooked position along the respective main frame component (9*a*; 9*b*) around the hooking point and to an upper area (20) of the central column (15), in one position (21*a*'; 21*b*') the rubber band extends from an outer end of said main frame component to the upper area of the central column, to form additional support for the sheet-like objects which are on the stand head (2) when the latter is in an unfolded position for use.

17. A stand which can be collapsed during transportation and storage and be unfolded for use, comprising an upper stand head (2) having a central column arranged to support sheet-like objects on opposing main frame components, and a rod-shaped central part (4) as well as extendable main stays (6, 7) and preferably a lower leg arrangement (5), characterised in that the upper stand head (2) comprises extendable main stays (6, 7) each of which is freely extendable and allows lengthening or shortening at a free end thereof, the extendable main stays (6, 7) are fastened at rotation points (8*a*, 8*b*) which also form hooking points for a rubber band (21*a*; 21*b*); wherein the rubber band extends in a hooked position along the respective main frame component (9*a*; 9*b*) around the hooking point and to an upper area (20) of the central column (15), in one position (21*a*'; 21*b*') the rubber band extends from an outer end of each main frame component to the upper area of the central column, to form additional support for the sheet-like objects which are on the stand head (2) when the latter is in an unfolded position for use.

18. The stand as stated in claim 17 characterised in that each of said extendable main stays (6, 7) includes first and second stays and that each first stay (6*a*; 7*a*) is at one end fastened rotatably (8*a*; 8*b*) to a lower central area of the stand head (2), and that each second stay (6*b*; 7*b*) is fastened displaceably relative to the respective first stay (6*a*; 7*a*) by an upper guiding and holding device (10*a*; 10*b*) which passes through the respective first stay and displaceably engages the respective second stay at a groove in said second stay, and that each second stay (6*b*; 7*b*) in addition is fastened to a lower guiding and holding device (11*a*; 11*b*) which passes through the second stay (6*b*; 7*b*) and displaceably engages the respective first stay at a groove in said first stay, and the lower guiding and holding device is also rotatably fastened to an upper cross stay (12*a*; 13*a*) and a lower cross stay (12*b*; 13*b*).

19. The stand as stated in claim 17, characterised in that the extendable main stays (6, 7) are fastened rotatably at respective rotation points (8*a*; 8*b*) at an inner end of one of the opposing main frame components (9*a*; 9*b*) in order thereby to have a common rotation point with respect to the lower central area of the stand head, the main frame components (9*a*; 9*b*) being in the shape of an open duct, comprising a bottom area (18) for support of the sheet-like objects, a front support edge (19) for retention of the sheet-like objects, as well as a rear load-carrying support edge (17).

* * * * *